US011231029B2

(12) United States Patent
Hoehne

(10) Patent No.: US 11,231,029 B2
(45) Date of Patent: Jan. 25, 2022

(54) COMPRESSOR FOR A COOLING DEVICE AND A REFRIGERATION MACHINE

(71) Applicant: Pressure Wave Systems GmbH, Munich (DE)

(72) Inventor: Jens Hoehne, Munich (DE)

(73) Assignee: Pressure Wave Systems GmbH, Taufkirchen (DE)

( * ) Notice: Subject to any disclaimer, the term of this patent is extended or adjusted under 35 U.S.C. 154(b) by 429 days.

(21) Appl. No.: 14/601,462

(22) Filed: Jan. 21, 2015

(65) Prior Publication Data

US 2015/0128616 A1 May 14, 2015

Related U.S. Application Data

(63) Continuation-in-part of application No. PCT/EP2013/065822, filed on Jul. 26, 2013.

(30) Foreign Application Priority Data

Jul. 27, 2012 (DE) ..... 102012213293.7

(51) Int. Cl.
*F04B 45/033* (2006.01)
*F04B 43/073* (2006.01)
(Continued)

(52) U.S. Cl.
CPC ..... *F04B 43/073* (2013.01); *F04B 45/033* (2013.01); *F04B 49/22* (2013.01);
(Continued)

(58) Field of Classification Search
CPC .... F04B 9/08; F04B 9/10; F04B 9/103; F04B 43/02; F04B 43/06; F04B 43/08;
(Continued)

(56) References Cited

U.S. PATENT DOCUMENTS 1,780,336 A 11/1930 Canton
2,772,543 A * 12/1956 Berry ..... F04B 39/0011 417/347
(Continued)

FOREIGN PATENT DOCUMENTS

CH 457147 A 1/1967
DE 2801670 A1 1/1978
(Continued)

OTHER PUBLICATIONS

Decision of Rejection from the Japanese Patent Office in the related foreign application JP2014-523333 dated Feb. 7, 2017 citing references A-E (4 pages).
(Continued)

*Primary Examiner* — Brian M King
(74) *Attorney, Agent, or Firm* — Imperium Patent Works; Darien K. Wallace

(57) ABSTRACT

A compressor device that periodically supplies compressed working gas to a cooling device loses less gas by not using a rotary valve. The compressor device includes a compressor chamber, a working gas connection, a working liquid connection, a pump, a compensation container and a membrane that is airtight and liquid-tight. The membrane divides the compressor chamber into a first volume containing a working gas and a second volume containing a working liquid. The working gas connection is coupled to the first volume, and the working liquid connection is coupled to the second volume. The pump periodically pumps the working liquid through the working liquid connection and into the second volume and as a result periodically compresses the working gas in the first volume. The membrane is constructed as a balloon or a bellows that surrounds the first volume. The compensation container contains working liquid and is connected to the pump.

19 Claims, 3 Drawing Sheets

(51) Int. Cl.

| | |
|---|---|
| ***F25B 9/14*** | (2006.01) |
| ***F25B 31/00*** | (2006.01) |
| ***F04B 49/22*** | (2006.01) |
| ***F04B 53/08*** | (2006.01) |
| ***F25B 9/00*** | (2006.01) |

(52) U.S. Cl.
CPC ..... *F04B 53/08* (2013.01); *F25B 9/00* (2013.01); *F25B 9/14* (2013.01); *F25B 31/00* (2013.01)

(58) Field of Classification Search
CPC .... F04B 45/02; F04B 45/033; F04B 45/0336; F04B 45/04; F04B 45/053; F04B 45/0536; F25B 9/00; F25B 9/14
See application file for complete search history.

(56) References Cited

U.S. PATENT DOCUMENTS

| | | | | | |
|---|---|---|---|---|---|
| 3,473,475 | A * | 10/1969 | Nocon | H02K 7/083 417/410.1 |
| 3,494,192 | A * | 2/1970 | Abduz | G01F 23/14 138/103 |
| 3,524,714 | A * | 8/1970 | Grove | F04B 43/1136 417/345 |
| 4,483,665 | A | 11/1984 | Hauser | |
| 4,515,516 | A | 5/1985 | Perrine et al. | 417/38 |
| 4,673,415 | A * | 6/1987 | Stanford | B01D 53/04 417/392 |
| 5,181,383 | A | 1/1993 | Goto | |
| 5,711,157 | A * | 1/1998 | Ohtani | F25B 9/14 62/467 |
| 6,615,591 | B1 * | 9/2003 | Kusada | F25B 9/02 62/335 |
| 7,407,501 | B2 * | 8/2008 | Zvuloni | A61B 18/02 128/898 |
| 2006/0110259 | A1 | 5/2006 | Puff et al. | |
| 2008/0253910 | A1 | 10/2008 | Caughley et al. | 417/472 |
| 2009/0158752 | A1 * | 6/2009 | Clayton | F04B 41/02 62/6 |
| 2010/0178184 | A1 | 7/2010 | Simmons et al. | 417/472 |

FOREIGN PATENT DOCUMENTS

| | | | | |
|---|---|---|---|---|
| DE | 10344698 | B4 | 9/2003 | |
| DE | 10344698 | B4 * | 9/2005 | F25B 1/00 |
| JP | S57-157076 | A | 3/1981 | |
| JP | S57-157076 | A | 3/1981 | |
| JP | S61-93282 | A | 10/1984 | |
| JP | 64-004882 | U1 | 6/1987 | |
| JP | H06-323672 | A | 5/1993 | |
| JP | H09-236343 | A | 2/1996 | |
| JP | 2002-349433 | A | 5/2001 | |
| JP | 2002-349433 | A | 5/2001 | |
| JP | 2008-542671 | A | 4/2006 | |
| JP | 2008-291865 | A | 5/2007 | |
| JP | S61-93282 | A | 10/2008 | |
| SU | 440534 | A1 | 7/1972 | |
| WO | WO2006/112741 | | 4/2006 | |
| WO | WO2011/018244 | | 8/2010 | |

OTHER PUBLICATIONS

English translation of the Decision of Rejection from the Japanese Patent Office in the related foreign application JP2014-523333 dated Feb. 7, 2017 listed in F above (5 pages).
International Search Report of the European Patent Office in the related international application PCT/EP2013/065822 dated Apr. 3, 2014 citing references A-G (3 pages).
Office action dated Feb. 21, 2013, from the German Patent Office in the related foreign application DE102012213293.7 citing references A and B (4 pages).
Office action from the Japanese Patent Office in the related foreign application JP2014-523333 dated May 31, 2016 citing references A-D (4 pages).
English translation of Office action from the Japanese Patent Office in the related foreign application JP2014-523333 dated May 31, 2016 listed in I above (5 pages).
Decision of Rejection dated Apr. 18, 2017 from the Japanese Patent Office in the related foreign application JP2015-523567 citing references A-B (3 pages).
English translation of the Decision of Rejection dated Apr. 18, 2017 from the Japanese Patent Office in the related foreign application JP2015-523567 listed in C above (4 pages).
Office action dated Jan. 2, 2018, from the European Patent Office in the related European application 13742422.0 citing references A-C (4 pages).
English translation of the Office action dated Jan. 2, 2018, from the European Patent Office in the related European application 13742422.0 listed in D above (3 pages).
Office action dated Apr. 19, 2018, from the European Patent Office in the related European application 13742422.0 citing reference A (5 pages).
English translation of the Office action dated Apr. 19, 2018, from the European Patent Office in the related European application 13742422.0 listed in B above (2 pages).

* cited by examiner

COMPRESSOR FOR A COOLING DEVICE AND A REFRIGERATION MACHINE

CROSS REFERENCE TO RELATED APPLICATION

This application is filed under 35 U.S.C. § 111(a) and is based on and hereby claims priority under 35 U.S.C. § 120 and § 365(c) from International Application No. PCT/EP2013/065822, filed on Jul. 26, 2013, and published as WO 2014/016415 A2 on Jan. 30, 2014, which in turn claims priority from German Application No. 102012213293.7, filed in Germany on Jul. 27, 2012. This application is a continuation-in-part of International Application No. PCT/EP2013/065822, which is a continuation of German Application No. 102012213293.7. International Application No. PCT/EP2013/065822 is pending as of the filing date of this application, and the United States is an elected state in International Application No. PCT/EP2013/065822. This application claims the benefit under 35 U.S.C. § 119 from German Application No. 102012213293.7. The disclosure of each of the foregoing documents is incorporated herein by reference.

TECHNICAL FIELD

The present invention relates to a compressor device and to a cooling device equipped with it or a refrigeration machine equipped with it.

BACKGROUND

Pulsed tube cooling devices and Gifford-McMahon cooling devices are used to cool cryo-pumps, nuclear spin tomography apparatuses, etc. These cooling devices use compressors. Gas compressors and in particular helium compressors are used in combination with rotary or turning valves, as shown in FIG. 1 (prior art). A helium compressor 10 is connected via a high-pressure line 11 and a low-pressure line 12 to a turning valve 13. On the outlet side, the turning valve 13 is connected via a gas line 14 to a cooling device 15 in the form of a Gifford-McMahon cooling device or a pulsed tube cooling device. The high pressure and low pressure sides of the gas compressor 10 are alternately connected via the turning valve 13 to the pulsed tube cooling device or to the Gifford-McMahon cooling device. The rate at which compressed helium is introduced into the cooling device 10 and out of it again is in the range of 1 Hz. Such cooling and compressor systems have the disadvantage that the motor-driven turning valve 13 causes losses of up to 50% of the input performance.

Cooling devices also use conventional acoustic compressors and high-frequency compressors. One or more pistons of the acoustic or high-frequency compressors are put in linear resonance oscillation by a magnetic field. But these resonance frequencies are in the range of a few tens of Hertz and are therefore not suited for being used with pulsed tube cooling devices or Gifford-McMahon cooling devices that generate very low temperatures in the range less than 10K.

Swiss patent CH457147B discloses a membrane compressor or membrane pump that has a working chamber subdivided by an elastic, gas- and liquid-tight membrane into a gas volume and a liquid volume. Liquid is periodically forced by a liquid pump into the liquid volume of the working chamber causing the elastic membrane to expand in the direction of the gas volume and to compress the gas, thus performing a compressor function. When the liquid leaved the working chamber and the elastic membrane retracts away from the direction of the gas volume, the elastic membrane performs a pumping function. The membrane compressor has the disadvantage that the gas-tight, liquid-tight and pressure-resistant seal of the elastic membrane in the working chamber is comparatively expensive. The membrane is heavily loaded, in particular in the area of the seal, so that either very expensive materials must be used or a lower service life must be accepted.

German patent DE10344698B4 discloses a heat pump and a refrigerating machine with a compressor device. The compressor device includes a compressor chamber in which a balloon is arranged. The balloon is periodically loaded with liquid so that the gas surrounding the balloon is periodically compressed and relaxed again. This has the disadvantage that the balloon casing can scrape or rub under certain operating states on the hard and possibly edged inner surface of the compressor chamber. As a result, the formation of perforations or fissures in the balloon casing can occur due to the pressure conditions.

Considering the disclosure of aforementioned patents, it is an object of the invention to provide a compressor device that has a longer service life and requires less maintenance that the aforementioned membrane and balloon compressors. Furthermore, it is an object of the invention to provide a cooling device and a refrigeration machine that use the novel compressor.

SUMMARY

The invention relates to an economical compressor device having an elastic membrane and to a cooling device equipped therewith and a refrigeration machine equipped therewith. A working liquid is present on one side of the membrane, and the working gas to be compressed is present on the other side of the membrane. The membrane is designed as a balloon or as a bellows. Because the gas volume is in the balloon and the liquid volume is outside the balloon, the balloon shell is always protected by a liquid film from damage from the hard inner surface (generally made of metal) of the compressor chamber when the balloon shell rubs on the inner surface due to irregular operating conditions. Because the working liquid is generally hydraulic oil, the protective effect is additionally improved by the lubricating effect of the oil. Instead of a balloon, a tubular bellows can also be used as the membrane. The bellows has the advantage that the volume enlargement or volume reduction is "directed" in the longitudinal direction of the bellows due to the design and the arrangement of the folds. Therefore, rubbing contact between the bellows and the hard inner surface of the compressor chamber is nearly eliminated. Thus, if a bellows is used as the compressor membrane, the gas volume can also be provided inside the bellows. This "directedness" of the volume change can be improved by positive guidance of the bellows along a rod having a longitudinal bearing. The bellows is usually made of a stainless steel alloy and is extremely gas-tight for all relevant working gases, the exception being hydrogen.

A compressor device includes a compressor chamber, a first working gas connection, a second working gas connection, a pump device, a compensation container, a cooling device and an elastic membrane that is gas-tight and liquid-tight. The membrane divides the compressor chamber into a first volume and a second volume. The membrane is constructed as a balloon that surrounds the first volume. The first volume contains a working gas, and the second volume contains a working liquid. The first working gas connection is coupled to the first volume, and the working liquid connection is coupled to the second volume. The pump device periodically pumps the working liquid through the working liquid connection and into the second volume and as a result periodically compresses the working gas in the first volume. The first working gas connection is coupled to the cooling device in the form of a Gifford-McMahon cooling device or a pulsed tube cooling device. The cooling device receives periodically compressed working gas from the first volume through the first working gas connection.

The compensation container contains working liquid and is connected to the pump device. The second working gas connection is also coupled to the first volume. The working gas exits the first volume through the first working gas connection and enters the first volume through the second working gas connection. The first working gas connection contains working gas at a higher pressure than does the second working gas connection. In one embodiment, the working gas is helium, and the membrane has a first layer of plastic facing the working liquid and a second layer of synthetic rubber facing the working gas.

In another embodiment, the compressor device includes a compressor chamber, a working gas connection, a working liquid connection, a pump device, a compensation container, a working gas reservoir and a bellows. The bellows divides the compressor chamber into a first volume and a second volume. The first volume contains a working gas, and the second volume contains a working liquid. The bellows is airtight and liquid-tight and surrounds the first volume. The working gas connection is connected to the first volume, and the working liquid connection is connected to the second volume. The pump device compresses the working gas in the first volume by periodically pumping the working liquid into the second volume. The compensation container is connected to the pump device and contains a portion of the working liquid. The first volume is connected to the working gas reservoir through a differential pressure regulator and through an over pressure valve.

In yet another embodiment, the novel compressor device is used in a refrigerator together with an evaporator and a condenser. The compressor device can also be coupled to a Gifford-McMahon cooling device or a pulsed tube cooling device.

Other embodiments and advantages are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

DETAILED DESCRIPTION

Figure 1:
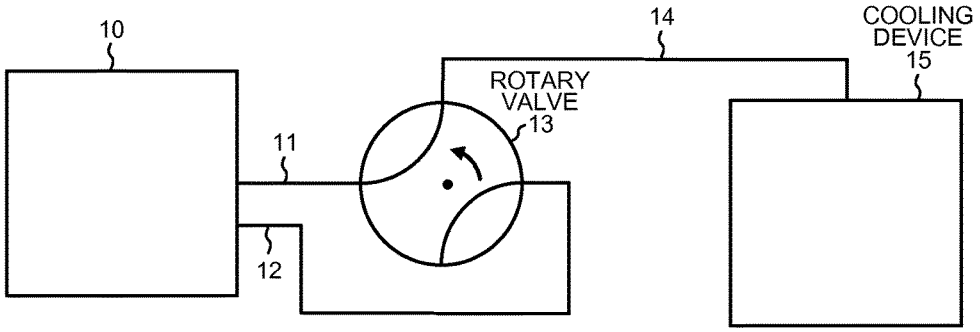
(PRIOR ART) FIG. 1
FIG. 1 (prior art) is a schematic diagram of a conventional helium compressor device with a rotary valve and a cooling device.

Reference will now be made in detail to some embodiments of the invention, examples of which are illustrated in the accompanying drawings.

A novel compressor has a balloon casing that is always protected from damage by a liquid film on the hard inner side (generally of metal) of the compressor chamber when the balloon casing rubs on the hard inner side due to irregular operating states. The balloon casing is always protected by the liquid film because the gas volume is inside the balloon and the liquid volume is outside the balloon. Because the working liquid is generally hydraulic oil, the protective effect is additionally improved by the lubricating oil effect.

Instead of a balloon, a tubular bellows can also be used as the membrane. A bellows has the advantage that due to the construction and the arrangement of the folds, the increase in volume and the reduction in volume takes place in a "directed" manner along the longitudinal direction of the bellows. A rubbing contact of the bellows with the hard inside of the compressor chamber is therefore nearly eliminated. The gas volume is also located inside the bellows when a bellows is used as the compressor membrane. This "directedness" of the change in volume can be improved by a forced guidance of the bellows along a rod with longitudinal bearing. The bellows usually is made of a high-grade steel alloy and is extremely gas tight for all relevant working gases, with the exception of hydrogen.

The novel compressor includes a compensation container for the working liquid. This makes it possible to use traditional liquid pumps, such as geared pumps. The compensation container for the working liquid ensures that the correct amount of working liquid in the correct pressure range is always available for the pump device. In the simplest case, the compensation container for the working liquid is a reservoir for the liquid working medium.

The novel compressor can be constructed as a compressor that does not transport gas or as a compressor that transports gas. In the case of a compressor that does not transport gas, a single working gas connection provides the only pressure oscillations, which are used to drive a cryo-cooling device, for example. In the case of a compressor that transports gas, compressed working gas is supplied via a first working gas connection designed as a high-pressure connection to a device connected downstream. Working gas with a lower pressure is conducted back into the compressor device via a second working gas connection that is designed as a low-pressure connection.

The gas volume in the novel compressor is connected to a gas reservoir. This can compensate for a reduced volume of the working gas in a downstream user, e.g., a cooling device, caused by lower temperatures. The working gas reservoir is connected by a differential pressure regulator to the gas volume of the compressor device. This makes the working gas available in an already compressed state. The working gas in the gas reservoir is approximately at the level of the low pressure of the compressor device. If the pressure of the working gas in the compressor device drops in the relaxing phase below the pressure in the gas reservoir, working gas flows via the differential pressure regulator from the gas reservoir into the gas volume of the compressor device.

Working gas can flow into the working gas reservoir through the connection of the gas reservoir to the gas volume in the compressor chamber via an over pressure valve if the pressure of the working gas in the gas volume becomes too high. This safety measure prevents damage to the compressor devices by over pressure. The pump device preferably comprises an electric drive because such a drive can be readily regulated.

A geared pump is especially suited as the pump device. Geared pumps are distinguished by a high service life, low maintenance expense and a low dead volume and are suitable for high-pressure applications up to 300 bar.

Hydraulic oil as defined by DIN 51524 is preferably used as the working fluid, which is additionally dewatered or water-free. The hydraulic oil is present in a closed system comprising a pump device, a compensation container for working liquid and a liquid volume in the compressor chamber such that during operation no water from the environment can be absorbed into the hydraulic oil. Alternatively, water can also be used as the working liquid, in particular when membrane materials that are extremely non-permeable to water are used, e.g., bellows of high-grade steel. Water is also advantageous as a working agent because in the case of defects water that penetrates into a downstream cryo-cooler can be more readily removed than can hydraulic oil that penetrates into the downstream cooler. Water is also more advantageous as a working agent in explosion-protected applications because water is noncombustible and non-explosive. Furthermore, using water is non-toxic and therefore environmentally friendly.

For cryo-applications, helium or nitrogen is preferably used as the working gas because of the operational temperature range.

The balloon-shaped membrane and the tubular bellows must be non-permeable and resistant to the particular working gas used, as well as to the working liquid. Because a material cannot always meet these different requirements, these membranes are preferably built up in several layers from different materials. Therefore, the membrane can be adapted to the working liquid as well as to the working gas. The compressor device according to the invention makes compressed working gas available in the frequency required for Gifford-McMahon cooling devices and pulsed tube cooling devices. If the compressor device is designed as a transporting compressor device, it can be used as the drive of a traditional refrigerating machine.

Figure 2:
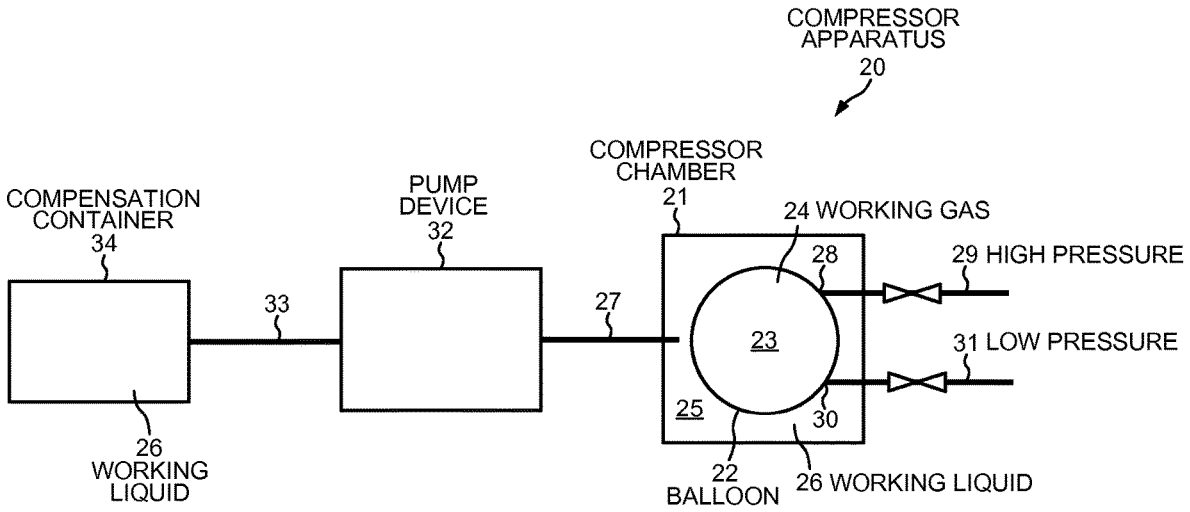
FIG. 2 is a schematic diagram of a first embodiment of the invention as a transporting compressor device.

FIG. 2 shows a first embodiment of the novel compressor device that is constructed as a compressor device that transports gas or the working gas. The compressor device includes a compressor apparatus 20 that comprises a compressor chamber 21 closed in a gas tight manner. A balloon or a balloon-shaped membrane 22 is arranged in the compressor chamber 21. The balloon 22 divides the compressor chamber 21 into a gas volume 23 for a working gas 24 and into a liquid volume 25 for a working liquid 26. The gas volume 23 is the inside of the balloon 22, and the liquid volume 25 is the area of the compressor chamber 21 outside of the balloon 22. The liquid volume 25 outside of the balloon 22 is connected to a first working liquid line 27 that runs out of the compressor chamber 21. The balloon 22 includes a first balloon opening 28 connected to the high-pressure gas outlet 29, and a second balloon opening 30 that is connected to the low-pressure gas outlet 31. The first working liquid line 27 empties into a pump device 32 that is connected via a second working liquid line 33 to a compensation container 34 for working liquid in the form of a working liquid reservoir. Working liquid 26 is periodically forced by the pump device 32 into the liquid volume 25 via the first working liquid line 27 and again let out of it. The working gas 24 in the balloon 22 is compressed by the pumping in of the working liquid 26 into the liquid volume 25. As a result of the working liquid 26 being let out into the working liquid reservoir 34, the working gas 24 expands in the balloon 22 and relaxes as a consequence. As a result of the periodic pressing in of working liquid 26 into the liquid volume 25, the working gas 24 in the gas volume 23 in the balloon 22 is periodically compressed and relaxed again. The compressed working gas 24 is supplied via the high-pressure gas outlet 29 to a downstream user, such as a cryo-cooling device (not shown). The working gas 24 is returned with a lower pressure via the low-pressure gas inlet 31 into the gas volume 23 in the balloon 22 so that the circuit is closed.

The compensation container for working liquid 34 ensures that there is always sufficient working liquid 26 present and that it can be pumped into the liquid volume 25 in the compressor chamber 21 in order to compress the working gas 24 in the gas volume 23 in the balloon 22. In the relaxing phase of the compressor device, the working gas 24 expands the balloon 22, and working liquid 26 is pressed via the first working liquid line 27, the pump device 32 and the second working liquid line 33 into the compensation container 34 for working liquid 26.

Figure 3:
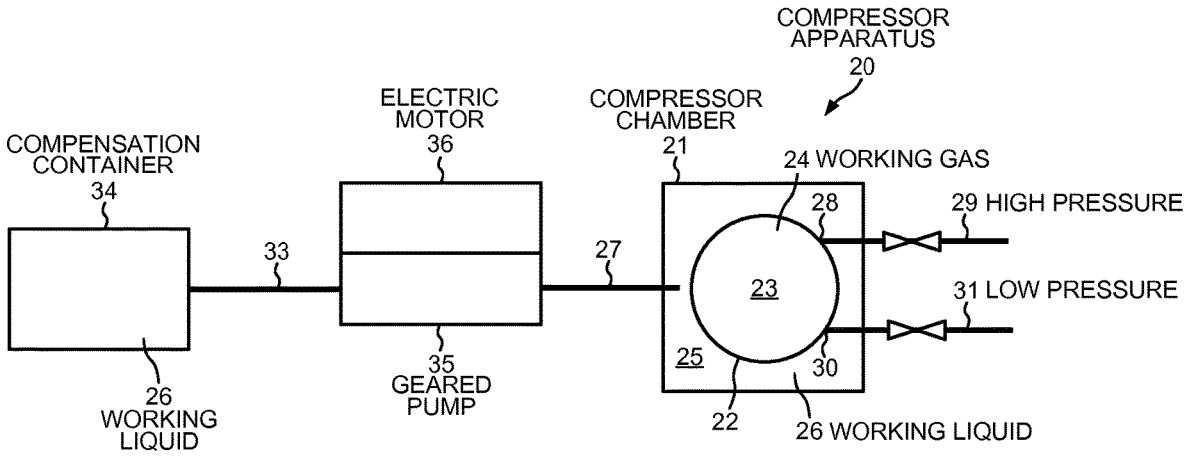
FIG. 3 is a schematic diagram of a second embodiment of the invention as a transporting compressor device.

FIG. 3 shows a second embodiment that differs from the first embodiment of FIG. 2 solely in that a geared pump 35 is used as the pump device and is driven by an electric motor 36. This type of pump device is especially advantageous because it has a long service life, low maintenance expenses and a small dead volume. Due to its construction, the geared pump 35 is suitable for high-pressure applications up to 300 bar.

Figure 4:
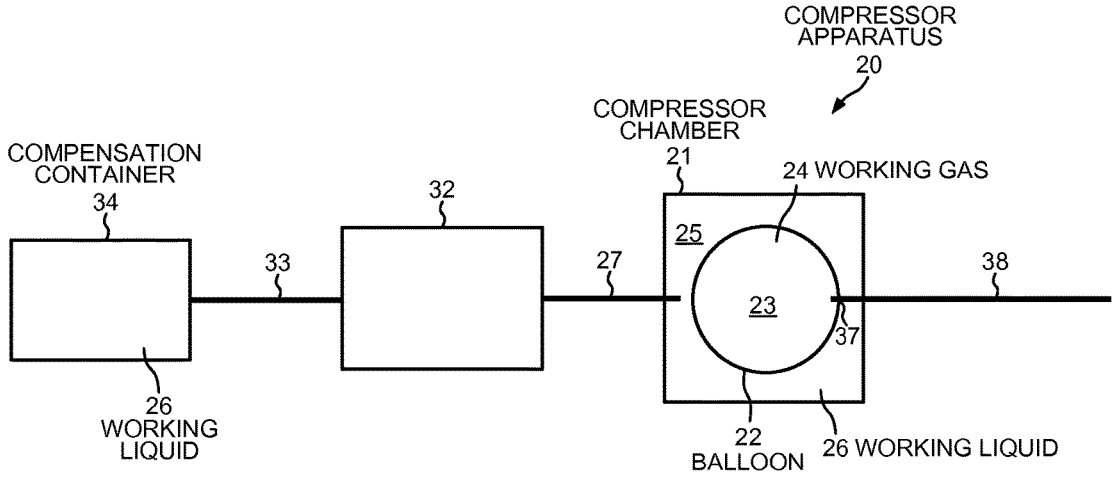
FIG. 4 is a schematic diagram of a third embodiment of the invention as a non-transporting compressor device.

FIG. 4 shows a third embodiment of the invention that differs from the first embodiment of FIG. 2 solely in that the compressor device is constructed as a non-transporting compressor device. The balloon 22 includes a balloon opening 37 connected to a working gas connection 38. Therefore, the gas volume 23 empties into the working gas connection 38. The periodic pressure change produced in the gas volume 23 is transferred via this working gas connection 38 onto the downstream cooler (not shown).

Figure 5:
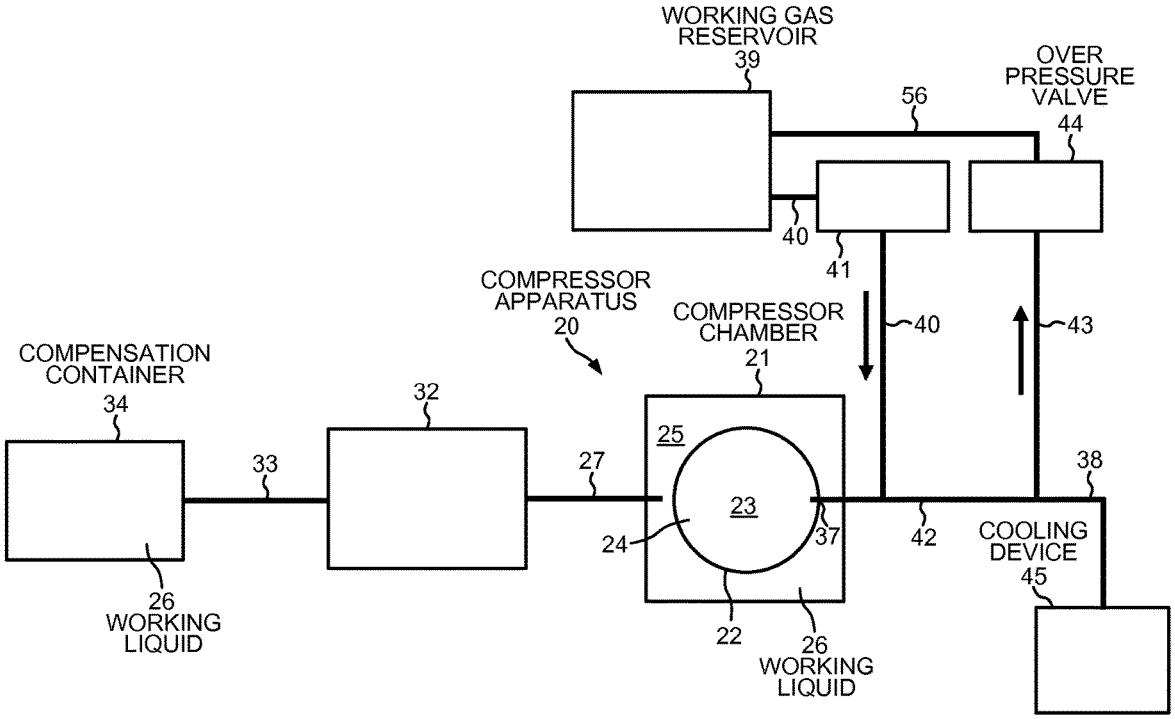
FIG. 5 is a schematic diagram of a fourth embodiment of the invention as a non-transporting compressor device.

FIG. 5 shows a fourth embodiment of the invention that differs from the third embodiment of FIG. 4 by a compensation device for working gas. The compensation device for working gas includes a working gas reservoir 39 that is connected via a first gas line 40, a differential pressure regulator 41 and a common gas line 42 to the gas volume 23 in the balloon 22. The working gas reservoir 39 is also connected via a second gas line 43, an over pressure valve 44 and the common gas line 42 to the gas volume 23 in the balloon 22. The common gas line 42 empties into the balloon opening 37. The working gas connection 38 branches off from the common gas line 42 and empties into a cooling device 45.

Working gas 24 flows via the first gas line 40, the differential pressure regulator 41 and the common gas line 42 into the gas volume 23 in the balloon 22 when the pressure of the working gas 24 in the gas volume 23 drops below the pressure in the working gas reservoir 39 due to low temperatures. Therefore, "working gas losses" that can occur in a downstream cooler can be compensated by the working gas reservoir 39. The working gas 24 to be supplied by the differential pressure regulator 41 is made available already pre-compressed for the further compressing in the gas volume 23 in the balloon 22. Working gas 24 can flow into the working gas reservoir 39 via the second gas line 43, the over pressure valve 44 and the common gas line 42 if the pressure of the working gas 24 becomes too high in the gas volume 23.

Figure 6:
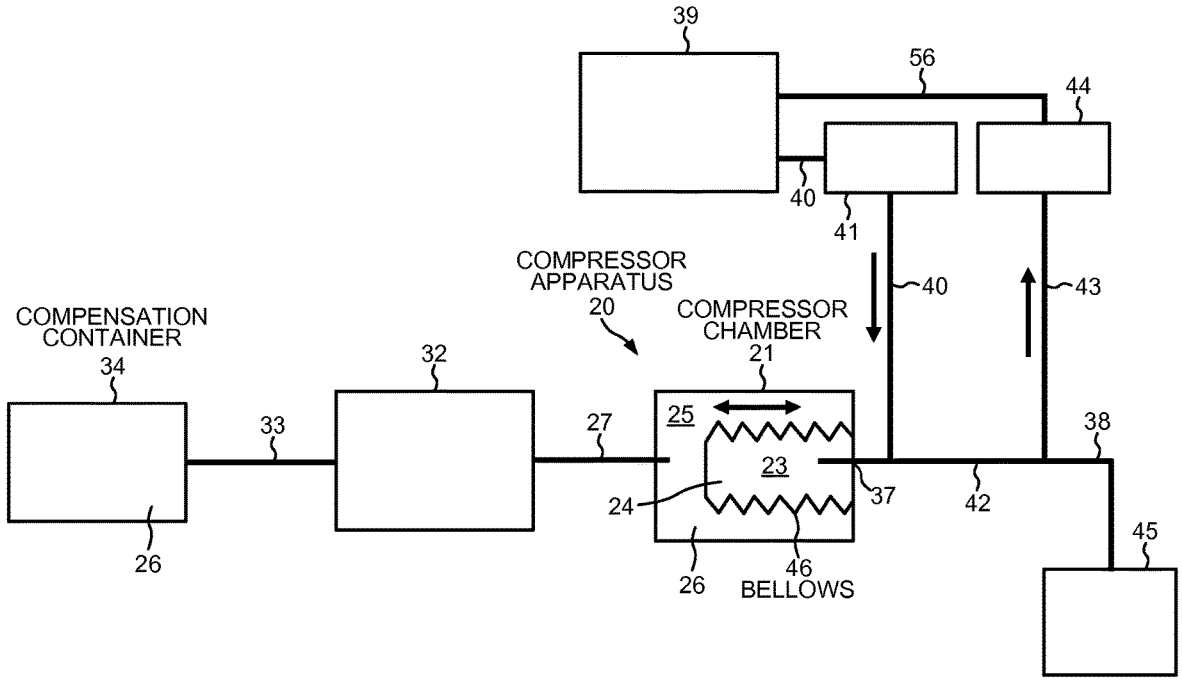
FIG. 6 is a schematic diagram of a fifth embodiment of the invention as a transporting compressor device.

FIG. 6 shows a fifth embodiment of the invention that differs from the fourth embodiment of FIG. 5 solely in that instead of a balloon, a tubular bellows 46 is used that surrounds the gas volume 23. The bellows 46 has the advantage over the balloon 22 that the volume enlargement and the volume reduction take place directed along the longitudinal axis of the tubular bellows 46. The bellows 46 is made of a high-grade steel and is extremely gas tight for all relevant working gasses, with the exception of hydrogen. In order to prevent the tubular bellows 46 from deviating from the longitudinal axis as it extends to maximum volume, the bellows is generally guided by a stable rod aligned along the longitudinal axis of the bellows and by longitudinal bearings (not shown). In this manner, the bellows 46 is reliably prevented from being damaged by any frictional contact with the inner surface of the compressor chamber 21.

Because the volume change takes place in a very controlled manner in the bellows 46, there is no danger that the bellows will scrape against the inner wall of the compressor chamber 21 and become damaged as a result. Consequently, when the bellows 46 is being used, the gas volume 23 can also be exchanged for the liquid volume 25. Just as in the second embodiment of FIG. 3, a geared pump driven by an electric motor can also be used as the pump device 32 in the embodiments of FIGS. 4-6.

Hydraulic oils defined by German Industry Standard DIN 51524 are suitable as the working liquid. These H, HL, HLP and HVLP oils are oils that are readily compatible with customary sealing plastics, such as NBR (acrylonitrile butadiene rubber), etc. However, NBR is not sufficiently helium tight. HF oils are frequently incompatible with customary sealing materials. (See http://de.wikipedia.org/wiki/Liste der Kunststoffe). Synthetic rubber, such as chlorobutyl, is suitable for helium-type balloons. Therefore, when helium is used as the working gas 24, it is advantageous for the balloon-shaped membrane 22 to include several layers, such as a layer of NBR facing the working liquid 26 in the form of hydraulic oil and a layer of chlorobutyl facing helium as the working gas 24.

Alternatively, water can also be used as the working liquid, in particular when membrane materials that are extremely impermeable to water are used, such as bellows made of high-grade steel. Water as the working agent is also advantageous because in the case of defects in a downstream cryo-cooler, penetrated water can be more readily removed than can hydraulic oil that has penetrated into a cooler connected downstream. Also, water is possible as a working agent in applications protected against explosions because water is non-combustible and non-explosive. In addition, water is non-toxic and therefore environmentally friendly.

In the non-transporting embodiments shown in FIGS. 4-6, no valve is provided in the working gas connection 38 running out of the gas volume 23. However, a valve can be provided here in order to build up a higher pressure difference in the expansion phase of the compressor device 20. That is, although the gas volume 23 in the compressor chamber 21 is already increased in the expansion phase, the valve in the working gas connection 38 is still closed. This valve is not opened until a predetermined pressure difference has been built up. In this manner, the backflow of the working gas 24 via the working gas connection 38 into the compressor device 20 can be accelerated.

LIST OF REFERENCE NUMERALS

10 helium compressor
11 high-pressure line
12 low-pressure line
13 turning valve
14 gas line
15 cooling device
20 compressor device
21 compressor chamber
22 balloon
23 gas volume
24 working gas
25 liquid volume
26 working liquid
27 first working liquid line
28 first balloon opening
29 high-pressure gas outlet
30 second balloon opening
31 low-pressure gas inlet
32 pump device
33 second working liquid line
34 compensation container for working liquid
35 geared pump
36 electric motor
37 balloon opening
38 working gas connection
39 working gas reservoir
40 first gas line
41 differential pressure regulator
42 common gas line
43 second gas line
44 over pressure valve
45 cooling device
46 bellows Although the present invention has been described in connection with certain specific embodiments for instructional purposes, the present invention is not limited thereto. Accordingly, various modifications, adaptations, and combinations of various features of the described embodiments can be practiced without departing from the scope of the invention as set forth in the claims.

What is claimed is:

1. A device comprising:

a compressor chamber;

a membrane that divides the compressor chamber into a first volume and a second volume, wherein the first volume contains a working gas and the second volume contains a working liquid, wherein the membrane is constructed as a balloon that surrounds the first volume, wherein the membrane is elastic, gas-tight and liquid-tight, and wherein the working liquid is a hydraulic oil that surrounds the outside of the balloon;

a first working gas connection that is coupled to the first volume;

a working liquid connection that is coupled to the second volume;

a pump device that periodically pumps the working liquid through the working liquid connection and into the second volume and as a result periodically compresses the working gas in the first volume;

a cooling device that receives compressed working gas via the first working gas connection from the first volume;

a working gas reservoir containing the working gas;

a differential pressure regulator adapted to allow the working gas to flow from the working gas reservoir into the first volume via the differential pressure regulator and the first working gas connection when the working gas in the first volume has a pressure lower than that of the working gas in the working gas reservoir;

and an over pressure valve adapted to allow the working gas to flow from the first volume into the working gas reservoir via the first working gas connection and then the over pressure valve when the pressure of the working gas in the first volume becomes too high so as to risk damaging the device, wherein the working gas is supplied to the cooling device via the first working gas connection without passing through either the over pressure valve or the working gas reservoir.

2. The device of claim 1, further comprising:

a compensation container containing working liquid, wherein the compensation container is connected to the pump device.

3. The device of claim 1, further comprising:

a second working gas connection that is directly connected to the first volume and to the cooling device but not directly connected to the working gas reservoir, wherein the working gas exits the first volume through the first working gas connection and enters the first volume through the second working gas connection, and wherein the first working gas connection contains working gas at a higher pressure than does the second working gas connection.

4. The device of claim 1, wherein the pump device includes an electric motor.

5. The device of claim 1, wherein the pump device is a geared pump.

6. The device of claim 1, wherein the pressure of the working gas in the first volume becomes too high when the pressure exceeds 300 bar.

7. The device of claim 1, wherein the working gas is helium or nitrogen.

8. The device of claim 1, wherein the membrane includes a first layer of plastic facing the working liquid and a second layer of synthetic rubber facing the working gas.

9. The device of claim 1, wherein the cooling device is a Gifford-McMahon cooling device or a pulsed tube cooling device, wherein the first working gas connection is coupled to the cooling device, and wherein the cooling device receives compressed working gas from the first volume through the first working gas connection.

10. The device of claim 1, wherein the first working gas connection is a high-pressure connection, and wherein the cooling device is connected to the first working gas connection.

11. The device of claim 10, further comprising:

a second working gas connection that is coupled to the first volume, wherein the second working gas connection is a low-pressure connection, and wherein the cooling device is connected to the second working gas connection.

12. The device of claim 1, wherein the device does not include a rotary valve.

13. A device comprising:

a compressor chamber;

a membrane that divides the compressor chamber into a first volume and a second volume, wherein the first volume contains a working gas and the second volume contains a working liquid, wherein the working liquid is a hydraulic oil, and wherein the membrane is elastic and constructed as a balloon that surrounds the first volume;

a high-pressure working gas connection that is coupled to the first volume;

a working liquid connection that is coupled to the second volume;

a pump device that pumps the working liquid through the working liquid connection and into the second volume and as a result compresses the working gas in the first volume;

a working gas reservoir containing the working gas;

a differential pressure regulator adapted to allow the working gas to flow from the working gas reservoir into the first volume via the differential pressure regulator and then the high-pressure working gas connection when the working gas in the first volume has a pressure lower than that of the working gas in the working gas reservoir;

an over pressure valve adapted to allow the working gas to flow from the first volume into the working gas reservoir via the high-pressure working gas connection and then the over pressure valve when the pressure of the working gas in the first volume becomes too high so as to risk damaging the device; and a cooling device connected to the high-pressure working gas connection, wherein compressed working gas is supplied from the first volume through the high-pressure working gas connection to the cooling device without passing through either the over pressure valve or the working gas reservoir.

14. The device of claim 13, further comprising:

a low-pressure working gas connection that is directly connected to the first volume and to the cooling device but not directly connected to the working gas reservoir, wherein the working gas exits the first volume through the high-pressure working gas connection and enters the first volume through the low-pressure working gas connection, and wherein the high-pressure working gas connection contains working gas at a higher pressure than does the low-pressure working gas connection.

15. The device of claim 13, wherein the cooling device is a Gifford-McMahon cooling device.

16. The device of claim 13, wherein the membrane includes a first layer of plastic facing the working liquid and a second layer of synthetic rubber facing the working gas.

17. The device of claim 13, wherein the device does not include any rotary valve.

18. The device of claim 13, wherein the working gas flows from the first volume, through the high-pressure working gas connection, through the over pressure valve, and into the working gas reservoir when the pressure of the working gas in the first volume exceeds 300 bar.

19. The device of claim 14, wherein the working gas flows from the working gas reservoir, through the differential pressure regulator, through the low-pressure working gas connection, and into the first volume when the working gas in the first volume has a pressure lower than that of the working gas in the working gas reservoir.

* * * * *